US005803172A

United States Patent [19]

Rajkovich

[11] Patent Number: 5,803,172

[45] Date of Patent: Sep. 8, 1998

[54] MINE SHAFT AND ADIT CLOSURE APPARATUS AND METHOD

[75] Inventor: Richard A. Rajkovich, Aurora, Minn.

[73] Assignee: Foam Concepts, Inc., Hermantown, Minn.

[21] Appl. No.: 613,498

[22] Filed: Mar. 11, 1996

Related U.S. Application Data

[63] Continuation-in-part of Ser. No. 153,813, Nov. 17, 1993, Pat. No. 5,497,829.

[51] Int. Cl.[6] ..... E21B 33/127; E21B 33/13

[52] U.S. Cl. ..... 166/285; 166/187; 166/192; 102/333

[58] Field of Search ..... 166/285, 292, 166/187, 192; 102/333; 206/221

[56] References Cited

U.S. PATENT DOCUMENTS

| | | | |
|---|---|---|---|
| 910,201 | 1/1909 | Jorgenson | 166/187 |
| 3,756,389 | 9/1973 | Firth | 206/47 A |
| 3,809,224 | 5/1974 | Greenwood | 206/219 |
| 3,837,279 | 9/1974 | Cooke, Jr. | 102/24 R |
| 4,052,939 | 10/1977 | Simmons et al. | 102/24 R |
| 4,280,943 | 7/1981 | Bivens et al. | 260/29.2 E |
| 4,487,129 | 12/1984 | Isaac | 102/313 |
| 4,492,165 | 1/1985 | Marz | 102/313 |
| 4,493,261 | 1/1985 | Simon et al. | 102/331 |
| 4,633,946 | 1/1987 | Jackson | 166/187 |
| 4,790,890 | 12/1988 | Miller | 199/2 |
| 4,846,278 | 7/1989 | Robbins | 166/286 |
| 4,913,233 | 4/1990 | Fitzgibbon, Jr. | 166/285 |
| 4,919,203 | 4/1990 | Fitzgibbon, Jr. | 166/187 |
| 5,000,261 | 3/1991 | Fitzgibbon, Jr. | 166/187 |
| 5,035,286 | 7/1991 | Fitzgibbon, Jr. | 166/187 |
| 5,273,110 | 12/1993 | Fitzgibbon, Jr. | 166/187 |
| 5,346,005 | 9/1994 | Robbins | 166/187 |

FOREIGN PATENT DOCUMENTS

| | | |
|---|---|---|
| 1210688 | 9/1906 | Canada . |
| 2060610 | 8/1992 | Canada . |

*Primary Examiner*—Terry Lee Melius
*Attorney, Agent, or Firm*—David George Johnson

[57] ABSTRACT

A mine shaft closure plug which is created by a self-expanding plastic foam on a platform positioned within the mine shaft. Multiple expansion foam containers are used to provide the foam. Each expansion foam container has two closed waterproof pouches, an inner pouch and an outer pouch, each containing a separate component of the foam. The inner pouch is contained within the outer pouch. Upon breaking the inner pouch, the separate foam components combine within the outer pouch to form a complete expansion foam. The foam expands slowly enough to provide sufficient time for the container to be placed on the platform. Once in position, the expansion foam bursts the outer pouch to form the expansion foam plug above the platform. Either the platform or the expansion foam containers may be lowered into place by attached tethers.

27 Claims, 23 Drawing Sheets

MINE SHAFT AND ADIT CLOSURE APPARATUS AND METHOD

CROSS REFERENCE TO PARENT APPLICATION

This application is a continuation-in-part of U.S. patent application Ser. No. 08/153,813, which was filed Nov. 17, 1993, now U.S. Pat. No. 5,497,829, and which is herein incorporated by reference.

FIELD OF THE INVENTION

The present invention relates to expansion foam borehole plugs, and more specifically to the use of expansion foam plugs to permanently seal a mine shaft or adit.

BACKGROUND OF THE INVENTION

With large diameter holes, such as abandoned mine shafts or adits, there is a danger that persons or animals may fall or wander into the opening and become injured. In addition, if the opening is not sealed tightly with a positive seal, there is no protection against pollution of surrounding ground water by rain run-off and no protection against soil erosion. Currently, mine shafts and adits are closed mainly through the use of concrete plugs or steel grates and doors. There are disadvantages to both of these techniques.

The concrete plugs which are typically used to seal a mine shaft or adit usually shrink over time, thus negating the effects of having a positive seal of the mine shaft. In addition, concrete tends to degrade over time with acid drainage, reducing the quality and life of the concrete plug. Further, constructing a concrete plug typically requires (1) the expensive construction of a false bottom to support the heavy weight of the plug, which creates an unsafe condition over time with the possibility that the concrete plug will sink or fall into the mine shaft, (2) typically at least three days or more of highly skilled labor to build, (3) that personnel must enter the mine shaft or adit and thus be subject to the risk of fire or cave-ins, and (4) good access roads and hard packed surrounding soil to enable the heavy concrete construction materials and equipment to be transported to the site.

If a steel grating or door is used to plug a mine shaft, it is very difficult achieve a positive seal of the shaft and receive the benefit of a reduced risk of ground water pollution and soil erosion. Steel is also affected by acid drainage and corrosion, and therefore suffers severe weakness over time making it unsafe and unreliable. Further, constructing a steel grating or door typically requires (1) expensive materials and reinforcement, (2) typically at least two days or more of highly skilled labor to build, (3) cutting and welding of steel, which poses an extreme fire hazard in the mine shaft or adit, (4) that personnel must enter the mine shaft or adit to handle heavy construction materials, thus increasing the chances of injury, and (5) good access roads and hard packed surrounding soil to enable heavy construction materials and equipment to be transported to the site.

Therefore, because of the disadvantages and limitations of typical concrete and steel mine shaft and adit closure devices, there is a need for a safe, easy to use, inexpensive way to create a permanent positive seal of a mine shaft or adit in a remote or difficult to reach location.

SUMMARY OF THE INVENTION

The present invention provides for a mine shaft closure plug which is created by a self-expanding plastic foam on a platform positioned within the mine shaft. Multiple expansion foam containers are used to provide the foam. Each expansion foam container has two closed waterproof pouches, an inner pouch and an outer pouch, each containing a separate component of the foam. The inner pouch is contained within the outer pouch. Upon breaking the inner pouch, the separate foam components combine within the outer pouch to form a complete expansion foam. The foam expands slowly enough to provide sufficient time for the container to be placed on the platform. Once in position, the expansion foam bursts the outer pouch to form the expansion foam plug above the platform. Either the platform or the expansion foam containers may be lowered into place by attached tethers.

DETAILED DESCRIPTION

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Borehole Decking Plug

The present invention provides for a borehole decking plug with the following advantages over prior art devices and methods:

1. The foam components are sealed so the operator is not subject to exposure.
2. The foam components are easily mixed inside a self-contained pouch.
3. Control of mixing is maintained with predetermined levels of components.
4. Reliability is improved by maintaining an accurate mix of components providing optimal foam creation.
5. Color coded foam components provide the operator with a visual reference of mixing.
6. The self-contained foam components reduce the amount of time required to mix and load.
7. Elimination of waste products such as mixing heads and syringes.
8. An external pouch which assists in creating adhesion of the deck plug to the walls of the borehole.
9. Elimination of metal parts that could create sparks.
10. Modifications that provide for underwater operation.

The present invention is useful in creating a borehole decking plug in many different types of blasting applications and configurations. FIGS. 1–4 show the context of the invention. The borehole decking plug of the present invention may be substituted for prior art plugs in the locations shown in the figures.

Figure 1:
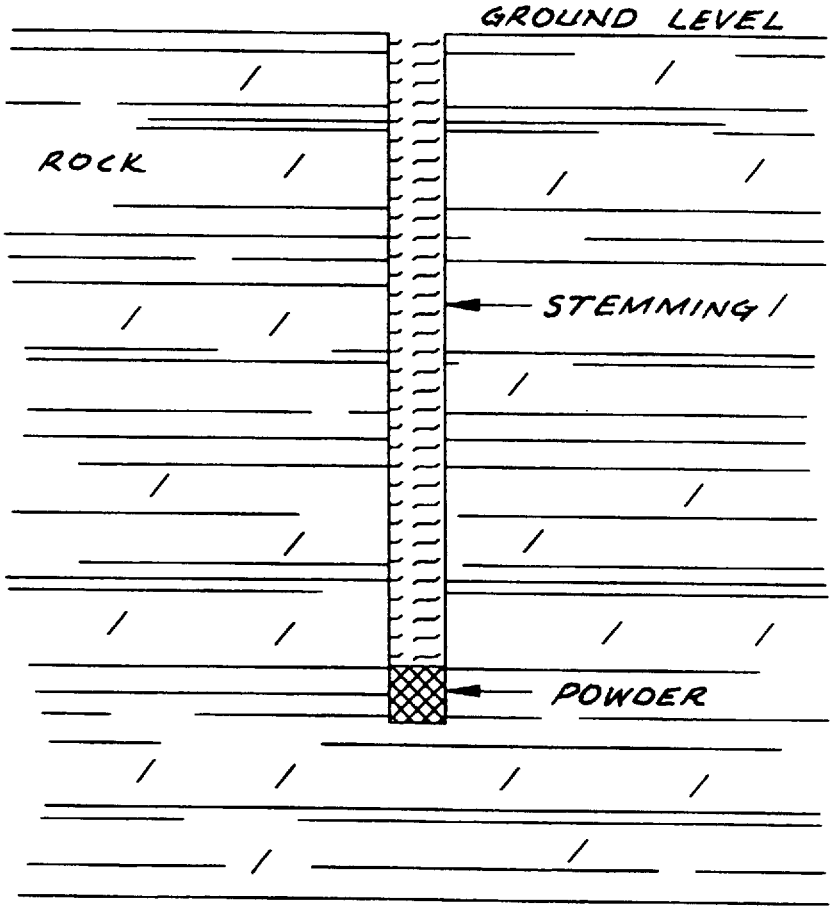
FIG. 1 is a cut-away view of a typical prepared basic blast hole configuration.

FIG. 1 shows a cut-away view of a typical prepared basic blast hole configuration. A powder charge is placed at the bottom of the borehole with stemming placed directly above the charge in order to control the effects of the blast. No borehole plug is used in this configuration.

Figure 2:
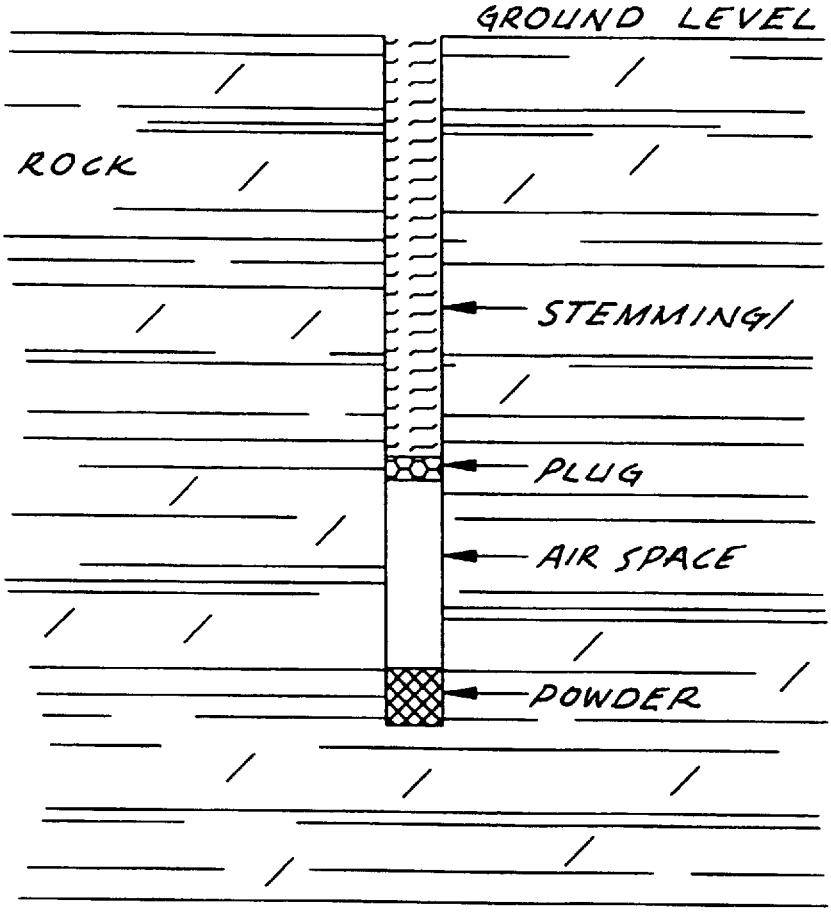
FIG. 2 is a cut-away view of a typical prepared basic blast hole configuration with air decking.

FIG. 2 shows a cut-away view of a typical prepared basic blast hole configuration with air decking. A powder charge is placed at the bottom of the borehole with a borehole plug placed at some distance above the charge, creating an air space between the charge and the plug. Stemming is placed directly above the plug in order to prevent rifling and control the effects of the blast.

Figure 3:
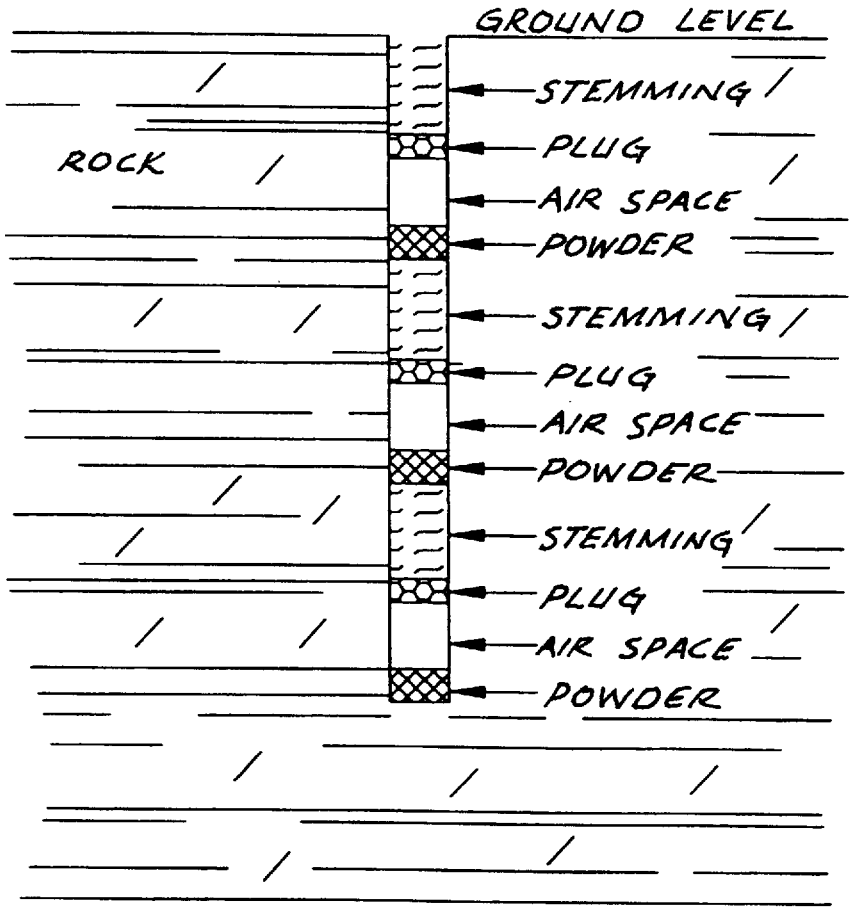
FIG. 3 is a cut-away view of a typical prepared basic blast hole configuration with multiple air decking.

FIG. 3 shows a cut-away view of a typical prepared basic blast hole configuration with multiple air decking. As in FIG. 2, a powder charge is placed at the bottom of the borehole with a borehole plug placed at some distance above the charge, creating an air space between the charge and the plug. Although not required, stemming may be optionally placed directly above the plug to a point below the top of the borehole. A second powder charge is placed on top of the optional stemming with a second borehole plug above it creating a second air space above the second charge. Stemming may then be optionally placed directly above the second plug, and further charges, plugs, and optional stemming may then be added as necessary.

Figure 4:
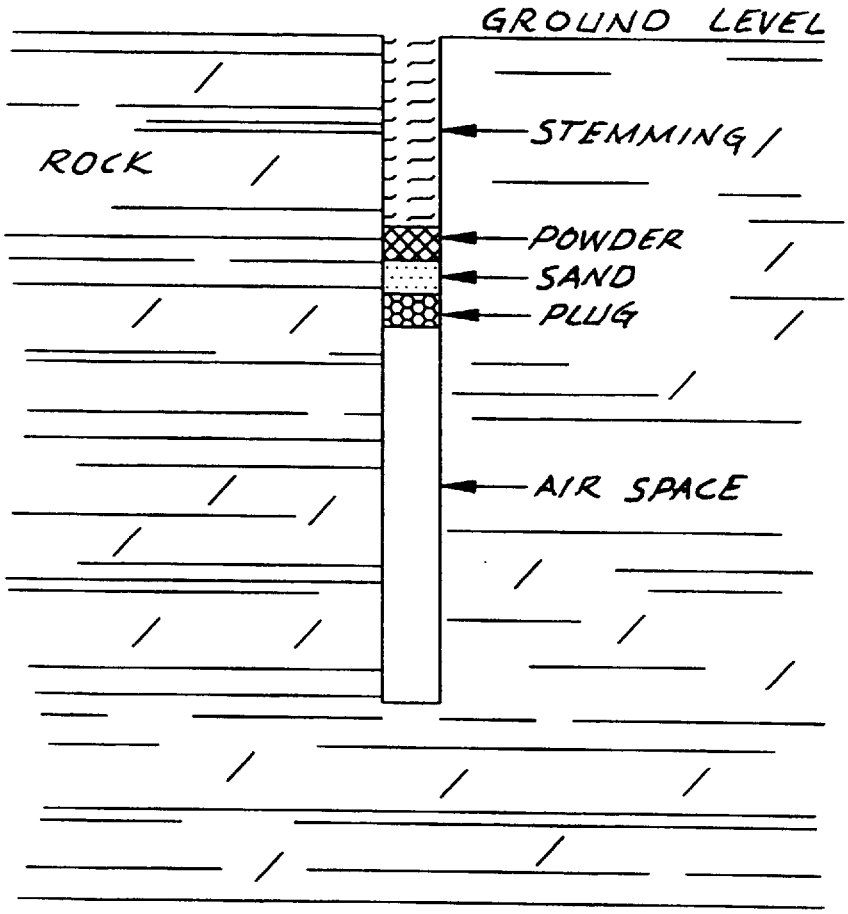
FIG. 4 is a cut-away view of a typical prepared basic blast hole configuration with a suspended charge.

FIG. 4 shows a cut-away view of a typical prepared basic blast hole configuration with a suspended charge. A borehole plug is placed at some distance above the bottom of the borehole, creating an air space in the lower portion of the borehole. Sand is placed directly above the plug, and a powder charge is placed directly on the sand. Stemming is then placed above the charge in order to control the effects of the blast.

Figure 8:
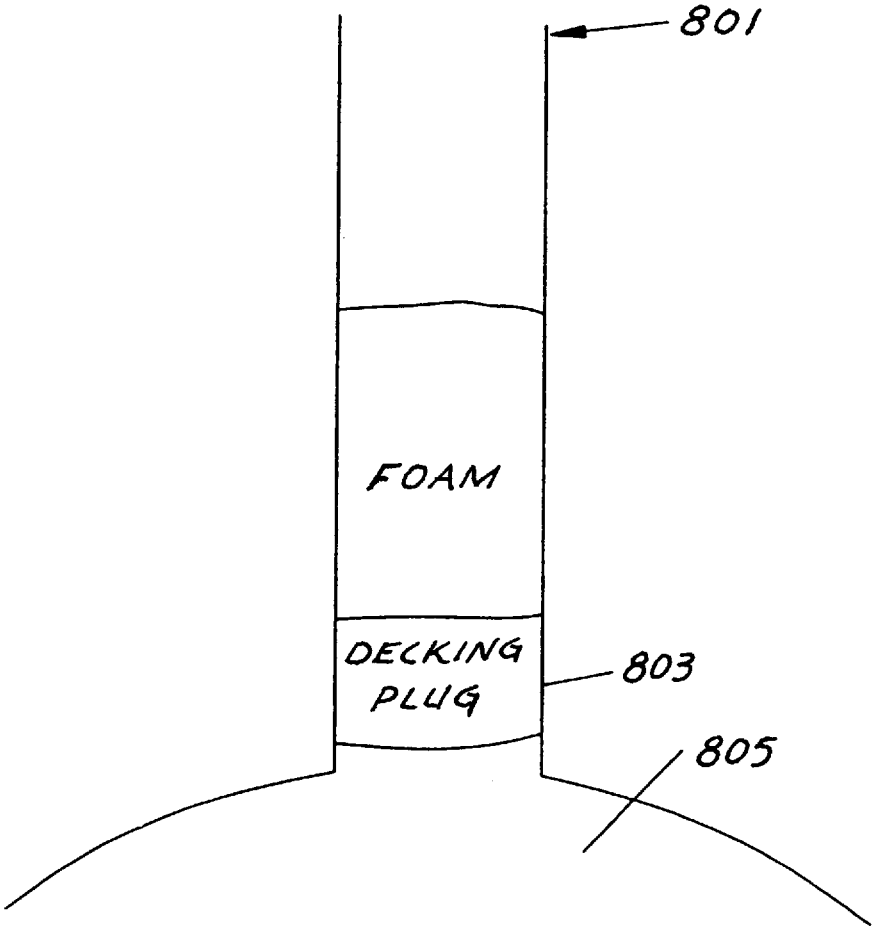
FIG. 8 is a cut-away view of a typical overhead borehole configuration compatible with the present invention.

FIG. 8 describes a cut-away view of a typical overhead borehole configuration. Typically used in underground mining applications, a borehole 801 is drilled upwards from a horizontal shaft of the mine 805. A pole or some other means is then normally used to place explosives up into the overhead borehole, and a decking plug 803 is typically placed at the bottom of the borehole to seal off the bottom of the borehole from the horizontal mine shaft.

Figure 9:
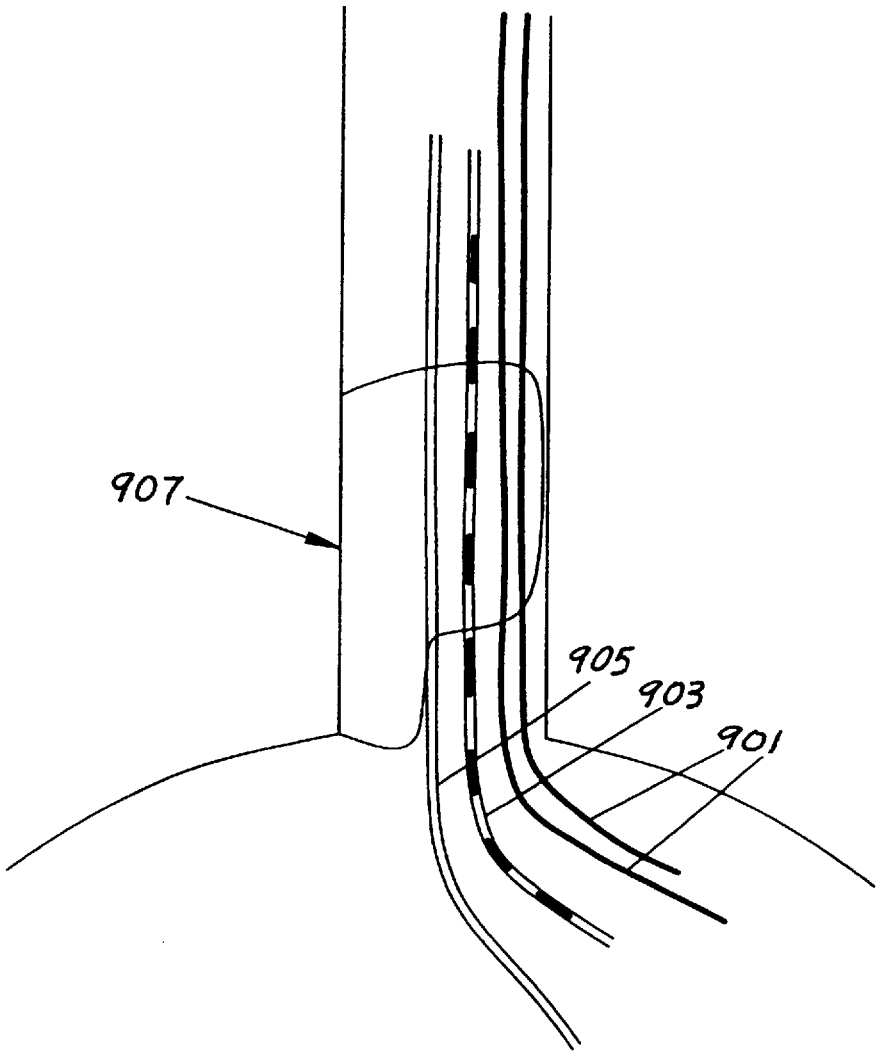
FIG. 9 is a cut-away view of a typical overhead borehole configuration for cable anchoring compatible with the present invention.

FIG. 9 describes a cut-away view of a typical overhead borehole configuration using cable anchoring. As with FIG. 8, this is typically used in underground mining applications to provide support for the ceiling of a horizontal mine shaft in order to prevent the collapse of the ceiling. Two overhead boreholes are normally drilled upwards some distance apart within a horizontal mine shaft. A number of cables 901 are typically inserted into the borehole, along with a grout tube 903 and a breather tube 905. A stem plug 907 is then usually placed at the bottom of the borehole to seal off the bottom of the borehole from the horizontal mine shaft. Grout is then typically pumped into the borehole through grout tube 903, and the air within the sealed borehole which is displaced by the grout is allowed to escape through the breather tube 905. The stem plug 907 prevents grout from falling out the bottom of the borehole into the horizontal mine shaft. Once the grout hardens, the cables 901 are firmly anchored within the borehole.

Figure 5:
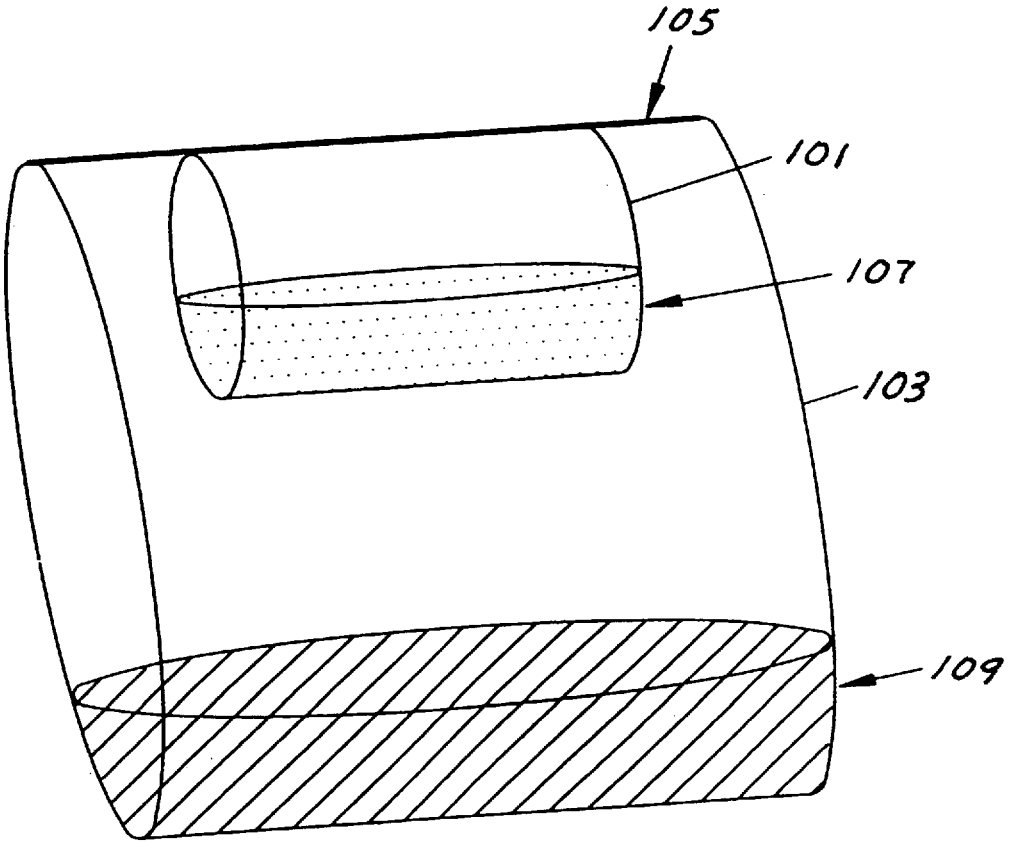
FIG. 5 is a perspective view showing an inner and an outer pouch of a typical borehole decking plug compatible with the present invention.

FIG. 5 is a perspective view of a borehole decking plug compatible with the present invention. An inner pouch 101 containing a first expansion foam component 107 is sealed inside of an outer pouch 103 containing a second expansion foam component. The inner pouch 101 and outer pouch are sealed along a seal 105. The pouches are typically made from tubular plastic film, are waterproof (liquid impervious), and are substantially clear so that their contents may be observed by an operator. The seal 105 joining the inner pouch 101 and outer pouch 103 allows the operator to easily grasp the inner pouch 101 within the outer pouch 103, preventing the inner pouch 101 from sliding around within the outer pouch 103 making it difficult to grasp. Further, the inner pouch 101 is typically made of thinner film than the outer pouch 103, such that the inner pouch 101 will break before the outer pouch 103 when mechanical pressure is applied.

Figure 6:
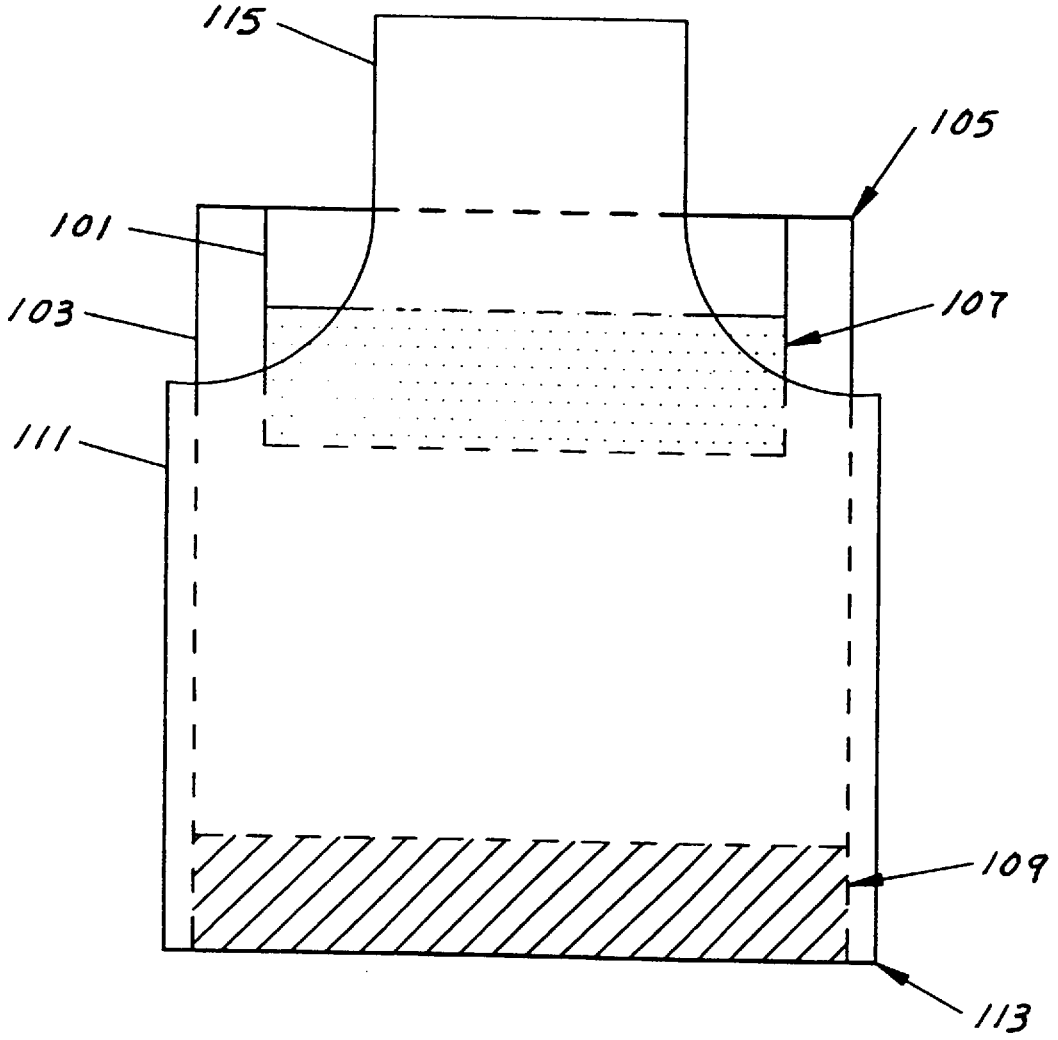
FIG. 6 is a plan view showing an inner pouch, an outer pouch, and an open external pouch of a typical borehole decking plug compatible with the present invention.

FIG. 6 shows how the inner pouch 101 and outer pouch 103 are held by an external pouch 111 ("diaper") which prevents the expanding foam from falling downward into the borehole when the outer pouch 103 bursts from foam expansion. The foam typically forms a decking plug with a positive seal by filling the external pouch 111 and expanding upward to adhere to the walls of the borehole. The external pouch 111 is typically made from plastic film, similar to the inner and outer pouches 101, 103, and is sealed around the outer pouch at 113. Additionally, the external pouch 111 normally provides a handle 115 to which a tether can be attached for suspending the device at a predetermined level within the borehole.

Figure 7:
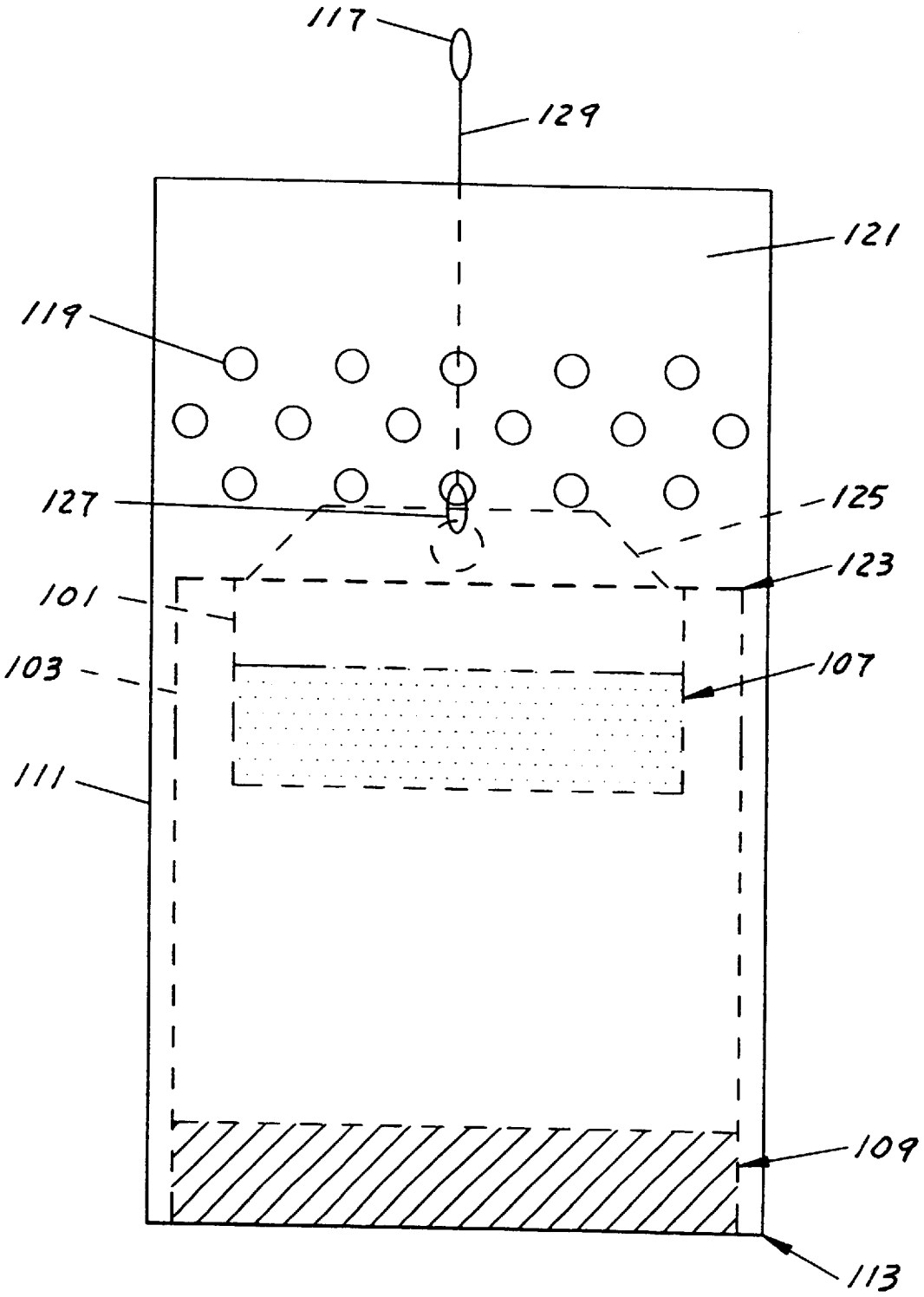
FIG. 7 is a plan view showing an inner pouch, an outer pouch, and an open external pouch of a typical borehole decking plug for underwater use compatible with the present invention.

FIG. 7 shows an alternative embodiment of the present invention for use with underwater blasting applications. The underwater embodiment is similar to that shown in FIG. 6, but typically uses a different structure for the external pouch 111. The external pouch 111 normally extends upward and is sealed at 121, forming a roof above the inner pouch 101 and outer pouch 103 containing expansion foam A and B components 107 and 109. The external pouch 111 typically contains a number of holes 119 located substantially between the mid-point and a point below the top edge of the external pouch 111, which allow water to be pushed out by the foam as it expands upward. An additional flap 125 is preferably sealed at 123 onto the inner pouch 101 and outer pouch 103 inside the external pouch 111. A cord 129 with a tether attachment 117 is normally fastened to the flap 125 at 127. This provides a means of attaching a tether for suspending the device at a certain level within the borehole. Once the expansion foam components are mixed, the device is typically lowered under water into the borehole. The device may optionally be weighted, such as with sand, in order to provide greater negative buoyancy. Once in position within the borehole, the expansion foam normally bursts the outer pouch 103 and seals the lower portion of the external pouch 111 to the walls of the borehole. As the foam continues to expand, it typically rises to the top of area 121 of the external pouch 111. As there are no holes in the very top portion of the external pouch 111, the foam expands outward, typically sealing to the walls of the shaft and pushing water from within the external pouch ill through the open holes 119.

The preferred embodiment of the present invention contains no metal parts, such as air valves or fittings, that could create sparks and prematurely set off a charge.

The preferred two-part expansion foam typically comprises an isocyanate (A) compound and a polyol resin (B) compound. The preferred embodiment of the present invention uses foam FE 630-2.0 from Foam Enterprises, Inc., Minneapolis, Minn., but it will be recognized that other expansion foams with similar expansion characteristics, either polyurethane or non-polyurethane based, may be substituted for the FE 630-2.0 foam without loss of generality.

The A component acts as a catalyst and typically has a density of approximately 10.3 pounds per gallon (ppg). The B component may be of many different types of polyol resin blends, and typically has a density of approximately 10.2 ppg. The A component is typically visually dark in color, while the B component is typically visually more clear. It will be recognized that any number of chemically inert coloring agents may be added to either the A or B component in order to provide a stronger or different visual cue to aid an operator in mixing the components.

When combined, the A and B components typically expand to approximately 33 times the volume of their liquid state, resulting in a foam with a density of approximately 2.5–3.1 pounds per cubic foot (pcf) and a compressive strength of approximately 23 pounds per square inch (psi). In hot weather, at approximately 95° fahrenheit, the rise time is typically 10–20 seconds, the gel time is 30–55 seconds, and the tack free time is 50–80 seconds. In warm weather, at approximately 75° fahrenheit, the rise time is typically 20–30 seconds, the gel time is 80–95 seconds, and the tack free time is 100–125 seconds. In cold weather, the rise time, gel time, and tack free time are typically 20–30 seconds longer than the corresponding warm weather times. On average, a usable foam plug is formed 40–60 seconds after mixing the A and B components. It will be recognized that the foam density and reaction times are dependent on mix efficiency, temperature, and resultant foam thickness, and that the present invention accommodates a wide variation in these factors without loss of functionality. The chemistry of the foam may be adjusted for optimum performance, but a typical ratio of component A to component B of the foam is approximately 4 to 3. The amount of component A may be increased or decreased depending on the application. Increasing the proportion of component A to component B results in a harder foam, but generates more heat during the expansion phase of the foam. Decreasing the proportion of component A to component B normally results in a softer foam but with less heat generated. The ratio of component A to component B may be increased to substantially 3 to 2 on the upper range or decreased to substantially 3 to 7 on the lower range.

During the expansion phase, the foam typically remains warm to the touch externally, but may reach temperatures as high as 300° fahrenheit internally. This level of heating is usually undesirable in many blasting applications due to the volatility of the explosives involved. In order to reduce the internal heat generated by the expanding foam, a freon component such as 141B may be added to the B component. It will be recognized that other freon mixtures such as R11, or other cooling agents with the same chemical cooling properties as freon, may be substituted without loss of generality. Typically, the B component contains a ratio of polyol resin to 141B freon of 3.33–1.67 to 1 in order to reduce the internal heat generated by the expanding foam during the expansion phase. Increasing the percentage of freon results in a cooler foam during the expansion phase, but the resulting foam is proportionally less dense.

For a typical 7-inch diameter borehole, preferably 2.9 oz. of component A is combined with 7.5 oz. of component B, where the ratio of polyol resin to 141B freon is 2.0 to 1. Borehole diameters ranging from 2 to 24 inches may be accommodated by proportionally increasing or decreasing the amount of the foam components and pouch sizes as appropriate.

To create a borehole decking plug with the preferred embodiment of the present invention, an operator forcefully squeezes the inner pouch 101 within the outer pouch 103, either by hand, foot, or some other means. The seal 105, joining the inner pouch 101 in a fixed position within the outer pouch 103, allows the operator to easily grasp the inner pouch 101 within the outer pouch 103, eliminating the problem of the inner pouch 101 sliding around within the outer pouch 103 making it difficult to grasp. Because the inner pouch 101 is typically constructed of thinner material than the outer pouch 103, the inner pouch 101 preferably bursts before the outer pouch 103, thus allowing component A 107 of the inner pouch 101 to combine with component B 109 within the outer pouch 103. The device is next typically turned inside out so that the inner pouch 101 and outer pouch 103 are contained within the external pouch 111. The operator then attaches a line to the tether attachment 115 of the external pouch 111, and preferably kneads the outer pouch 103 to mix the foam components. As component A and component B are preferably different colors and the outer pouch is typically made of a substantially clear flexible plastic, the operator may visually verify that the A and B components are properly mixed by observing the final color of the mixed components.

Once the A and B components are mixed, the operator typically uses the line to lower the external pouch 111 containing the outer pouch 103 into the borehole to a preselected depth. The operator normally suspends the pouch from the line at the preselected depth until the foam expands and bursts the outer bag 103 but not the external pouch 111. The foam typically forms a decking plug with a positive seal by filling the external pouch and expanding upward to adhere to the walls of the borehole.

Mine Shaft and Adit Closure Plug

The mine shaft and adit closure plug of the present invention is a safe, easy to use, inexpensive way to create a permanent positive seal of a mine shaft or adit in a remote or difficult to reach location. The plastic expansion foam plug does not shrink over time, and maintains a positive seal via a tight bond with the walls of the mine shaft or adit. The positive seal of the expansion foam plug protects ground water, eliminates soil erosion, helps control acid drainage, and prevents the plug from sliding down into a vertical or steep slope mine shaft. The expansion foam plug is lightweight and does not require the construction of a heavy false bottom for mine shafts or containment walls for adits. The materials for the expansion foam plug are portable, and may be packaged for easy transport by backpack to remote or difficult to access sites with little disturbance to the surrounding environment. Installation of the expansion foam plug is easy, reducing time and labor costs. A mine shaft can typically be sealed in 2–3 hours, and an adit can typically be sealed in 3–5 hours. In addition, the installation process is very safe. There is no need to enter a mine shaft to construct a false bottom, and no need to use power tools or welding torches which reduces the chance of injury or fire. The polyurethane foam swells to fill all voids and adheres to the rock of the mine shaft or adit walls, thus stabilizing fractured, weakened ground and minimizing weathering.

Figure 10:
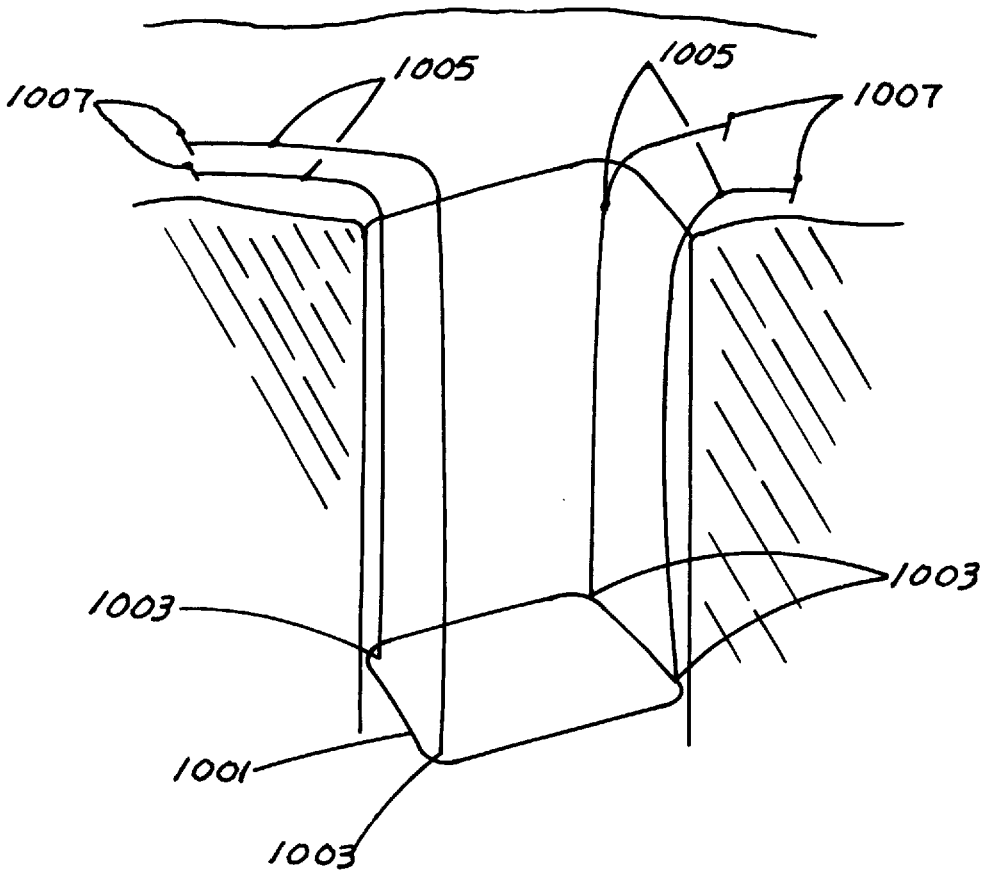
FIG. 10 is a cut-away view of a typical mine shaft closure platform positioned within a mine shaft compatible with the present invention.

FIG. 10 shows a cut-away view of a typical mine shaft closure platform positioned within a mine shaft. A platform 1001 is positioned within the mine shaft at a predetermined location via the use of tether 1005 attached to the platform at 1003. The tethers are secured at the top of the mine shaft at 1007. It will be recognized that the number, position, and means of attaching the tethers to the platform may be changed from that shown in FIG. 10 without loss of generality. The number of tethers can be increased or decreased, and their attachment positions to the platform can be changed from the preferred embodiment show in FIG. 10. It will also be recognized that the platform may be secured in the mine shaft by means other than tethers, such as support beams, or supported by wall outcroppings, without loss of generality. The preferred construction material for the platform typically is lightweight wood, but other platform construction materials such as construction lumber or, alternatively, a reinforced plastic tarp, are sufficient to act as a platform upon which the expansion foam plug will be constructed.

Figure 11:
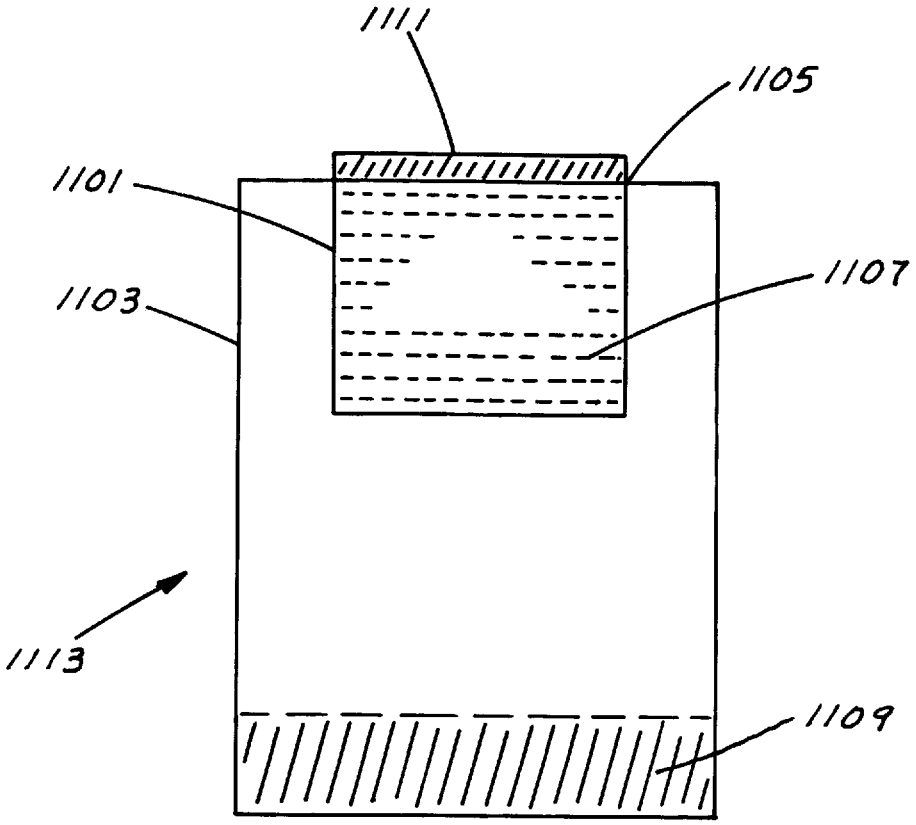
FIG. 11 is a plan view showing an inner pouch, an outer pouch, and a holding tab of a typical mine shaft or adit closure expansion foam container compatible with the present invention.

FIG. 11 shows a typical mine shaft and adit closure expansion foam container 1113 compatible with the present invention. An inner pouch 1101 containing an A component 1107 of the expansion foam is sealed within an outer pouch 1103 along with a B component 1109 of the expansion foam. The inner pouch 1103 and outer pouch 1103 are preferably sealed together along a seam 1105 to prevent the inner pouch 1101 from sliding within the outer pouch 1103, making the inner pouch easier to break open by applying mechanical pressure to the entire expansion foam container 1113. The inner pouch 1101 is made of a thinner film than the outer pouch 1103, and therefore the inner pouch 1101 breaks before the outer pouch 1103 when mechanical force is applied. A holding tab 1111 is shown attached to the outer pouch 1103 along the seam 1105. The holding tab allows the expansion foam container 1113 to be held in place while mechanical force is applied. Upon breaking the inner pouch 1101, the A and B components of the expansion foam combine within the outer pouch 1103, and are typically mixed by the operator in order to evenly distribute the components and thereby insure an even consistency to the foam. In the preferred embodiment of the present invention, the inner pouch 1101 has the dimensions of 12.5×19 inches, and the outer pouch 1103 has the dimensions 20.5×30 inches. The preferred expansion foam container 1113 is filled with approximately 22 pounds of A and B foam components, making it relatively easy for one person to carry one or two expansion foam containers in a backpack. Each preferred 22 pound expansion foam container expands to approximately 10 cubic feet of foam, which quickly hardens to a compressive strength of approximately 10 pounds per square inch. It will be recognized that a wide variety of expansion foam container sizes may be achieved with the present invention by either increasing or decreasing the dimensions of the inner and outer pouches, and by changing the corresponding amount of A and B foam components accordingly. It will also be recognized that the present invention may accommodate a wide variation in the density and expansion volume of the foam by changing the chemical composition of the A and B foam components as previously described above.

Figure 12:
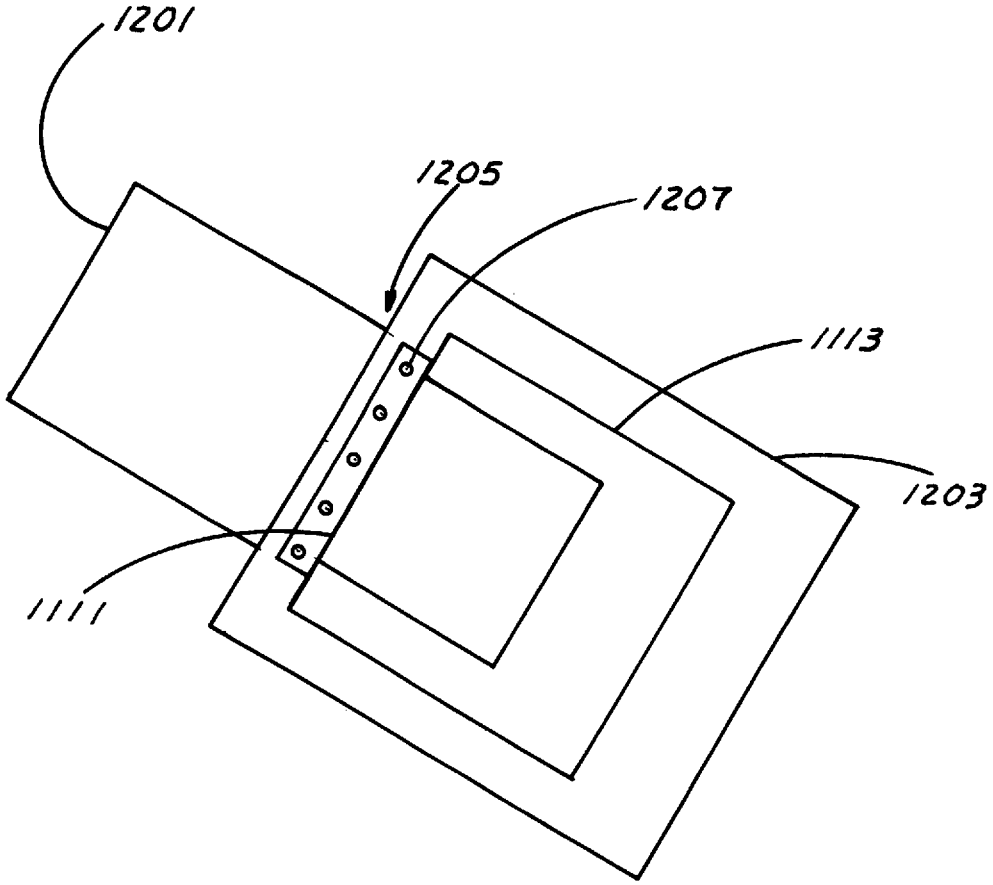
FIG. 12 is a perspective view of a mine shaft or adit closure expansion foam container positioned on a rupture board in a manner compatible with the present invention.

FIG. 12 is a perspective view of a mine shaft and adit closure expansion foam container positioned on a rupture board in a manner compatible with the present invention. A first board 1201 is attached to a second board 1203 by hinge 1205. An expansion foam container 1113 with holding tab 1111 is shown positioned on the rupture board just prior to rupturing. The holding tab 1111 is positioned along an optional rough surface 1207 on the second board 1203 in order to hold the expansion foam container 1113 in place during the rupturing process. In the preferred embodiment of the present invention, the first board 1201 and second board 1203 each have the dimensions of 14 inches wide by 24 inches long, but it will be recognized that a wide variety of expansion rupture board sizes may be achieved with the present invention by either increasing or decreasing the dimensions of the first and second boards. Once the expansion foam container 1113 has been placed on the rupture board, the first board 1201 is rotated about the hinge 1205 to come in contact with the expansion foam container 1113. By applying force to the first board 1201, such as by an operator stepping on it, the force is evenly transferred by the first board 1201 to the expansion foam container 1113 thereby breaking the inner pouch 1101, allowing the A foam component 1107 and B foam component 1109 to combine together in the outer pouch 1103.

FIGS. 13*a* through 13*k* show a cut-away view of a typical adit closure process and expansion foam plug. A first (back) bulkhead 1301 is positioned within the adit. The position of the back bulkhead 1301 controls how far away the expansion foam plug will extend in from the adit portal. A second (front) bulkhead 1303 is positioned within the adit at a location closer to the portal than the back bulkhead 1301. The position of the front bulkhead 1303 controls how close the expansion foam plug will be to the portal. Typically, the front bulkhead is positioned several feet in from the portal to allow enough room for a protective bulkhead to be constructed in front of the front bulkhead 1303. The space 1305 between the back bulkhead 1301 and the front bulkhead 1303 is subsequently filled with expansion foam 1307 to plug the adit. Therefore, the distance between the back and front bulkheads controls the length of the expansion foam plug. For example, given an adit which is six feet high by six feet wide, typically the back bulkhead may be positioned 16 feet in from the portal, and the front bulkhead positioned 10 feet in from the portal, thus creating a six foot long space between the bulkheads where the expansion foam plug will be constructed.

Figure 13A:
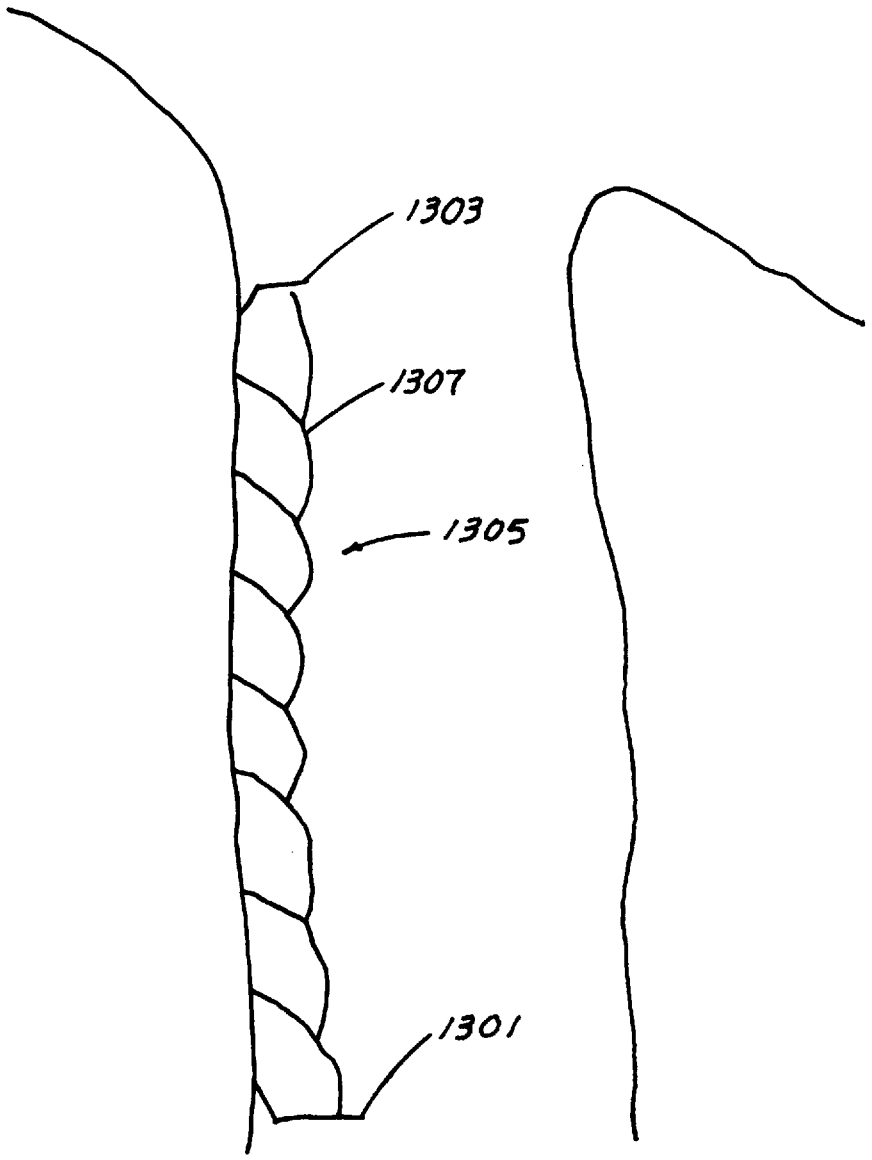
FIGS. 13*a* through 13*k* show a cut-away view of a typical adit closure process and expansion foam plug compatible with the present invention.
Figure 13B:
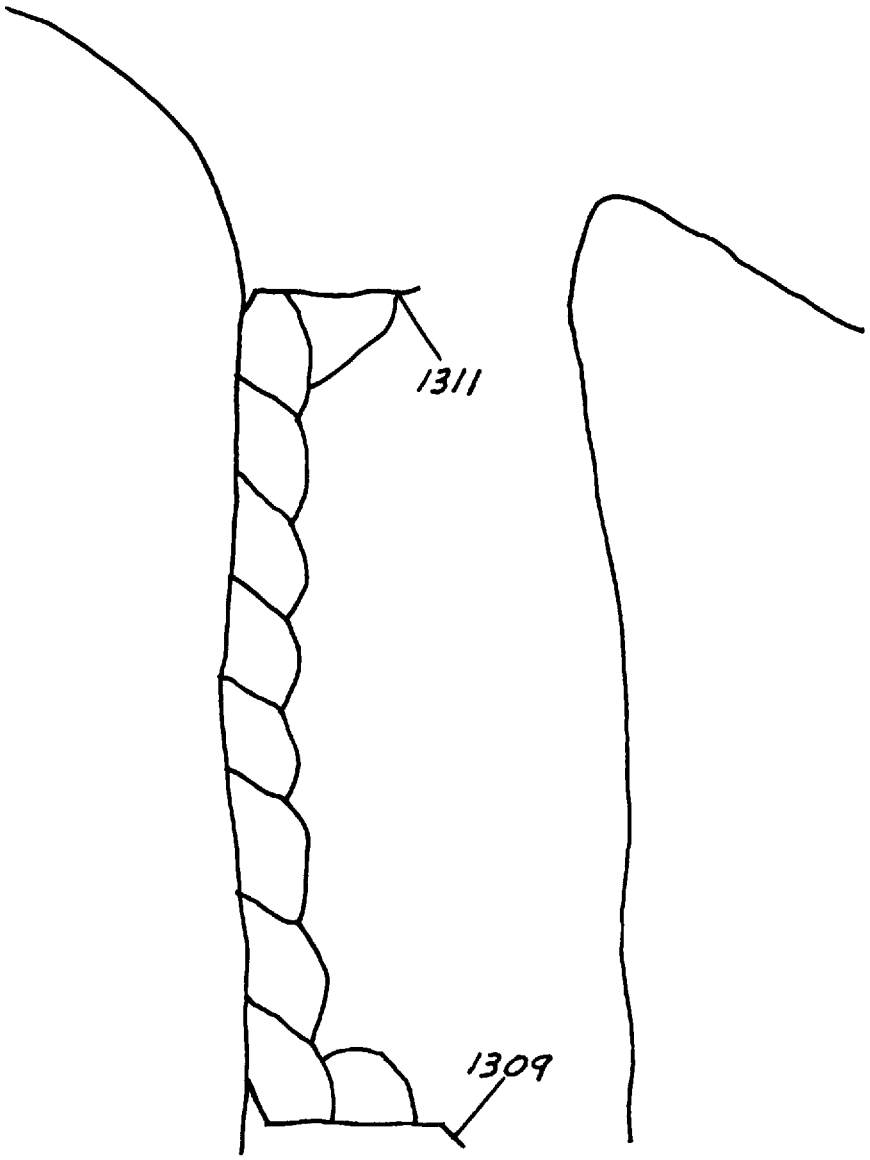
Figure 13C:
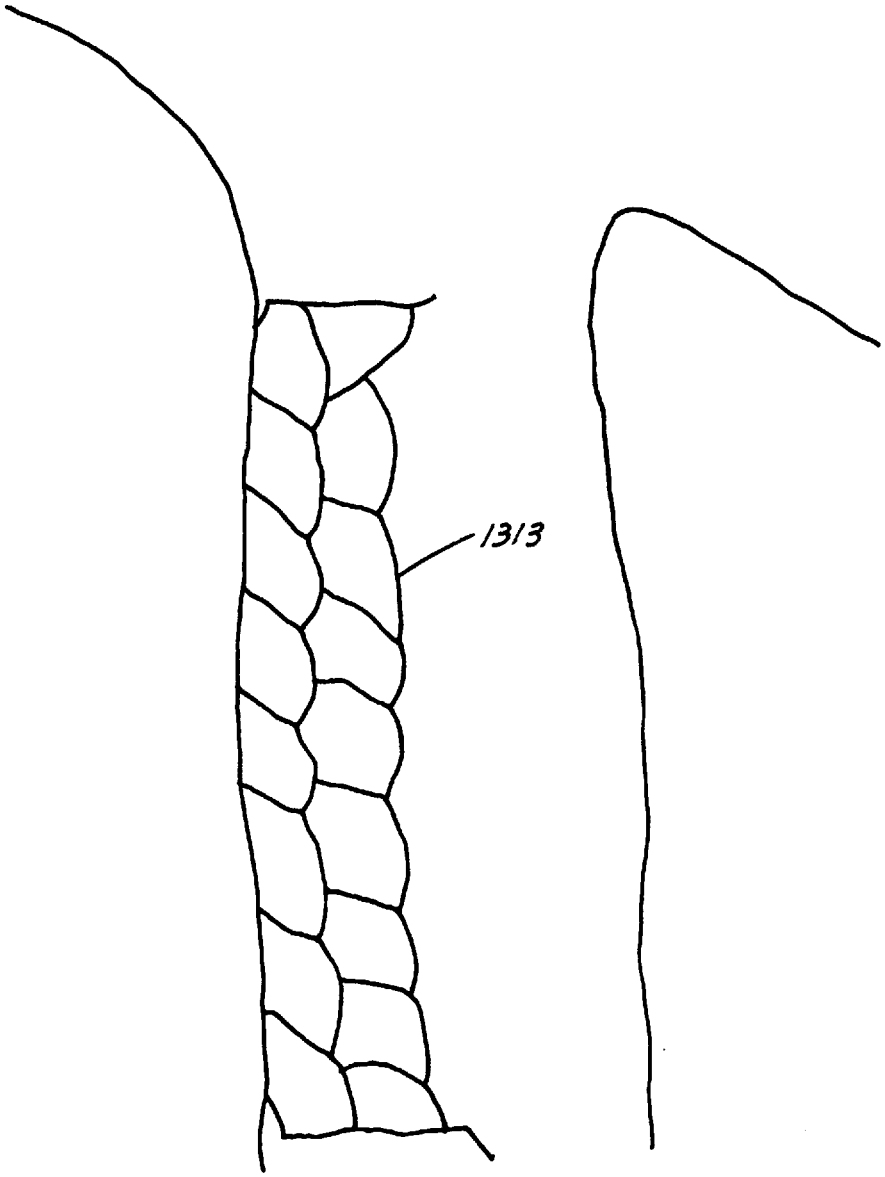
Figure 13D:
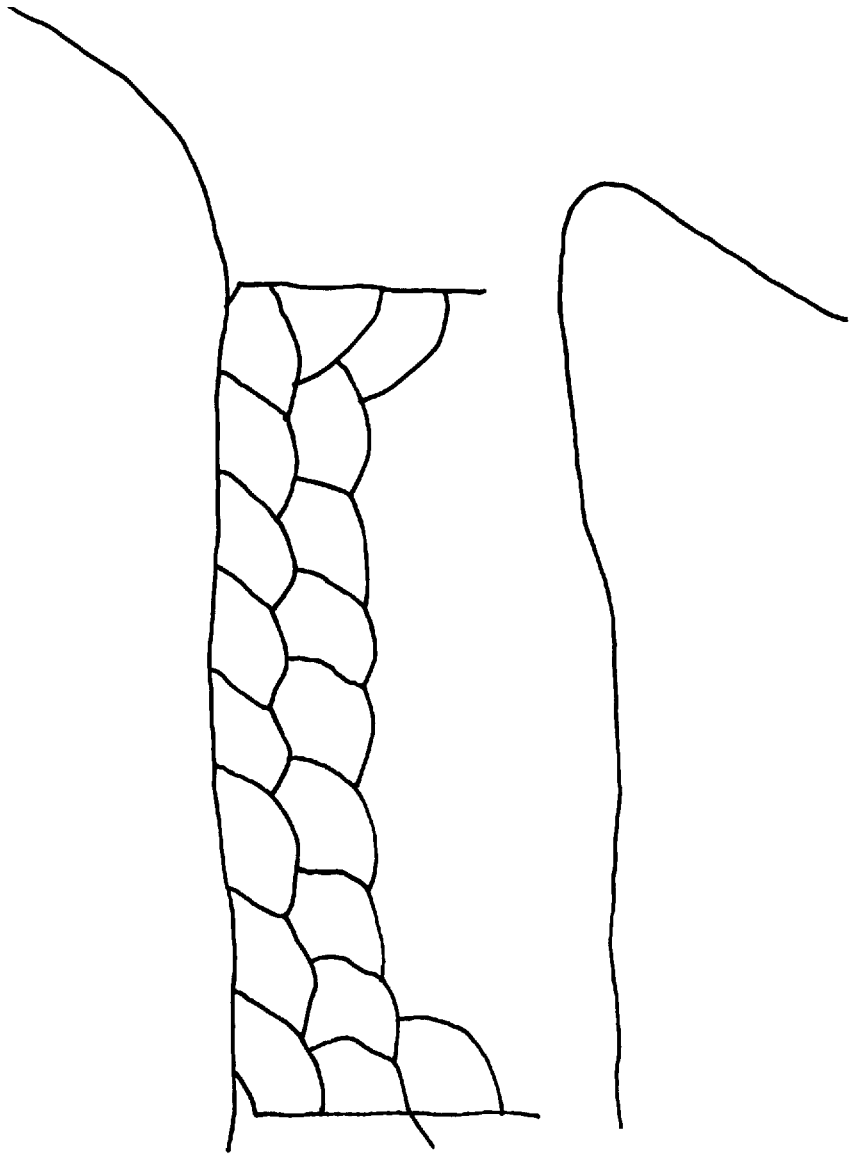
Figure 13E:
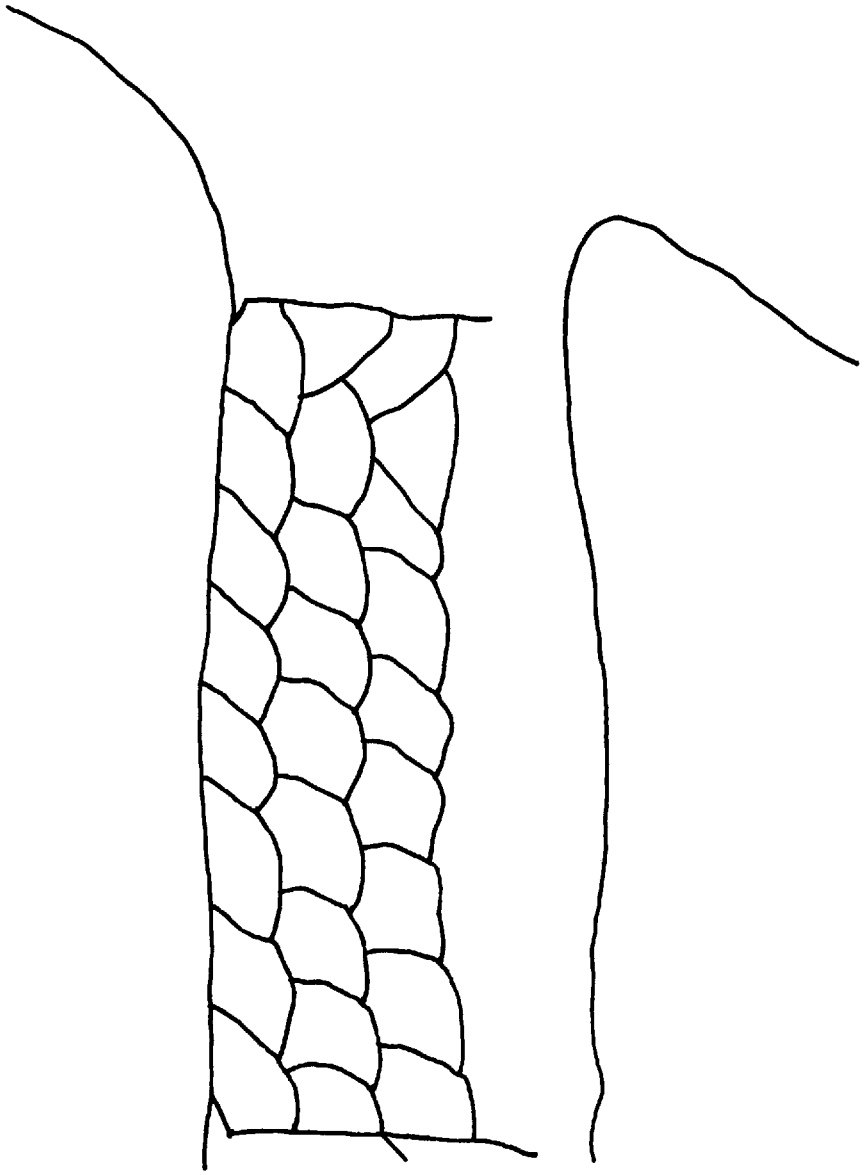

Once the bulkheads (1301, 1303) have been positioned, a first layer of foam 1307 is placed on the floor of the adit between the bulkheads. As shown in FIG. 13*a*, it is possible for bulkheads (1301, 1303) to be incrementally constructed during the formation of the expansion foam plug 1307. In the preferred method of incremental construction, cardboard boxes, in which the expansion foam containers are shipped, are cut open and spread across the adit, and then tacked into place with the expansion foam itself as it hardens. The cardboard acts as a dam for the foam as it subsequently expands in the space between the bulkheads. After the first layer of expansion foam 1307 is complete, the cardboard containers (1309, 1311) are tacked into place with foam on top of the first layer as shown in FIG. 13*b*. A second layer of expansion foam 1313 is then placed between the front and back dams (1309, 1311) as shown in FIG. 13*c*. FIGS. 13*d* and 13*e* show the process of damming, tacking, and foaming repeated for the next layer of foam. It will be recognized that this process may be repeated as many times as necessary in order to fill the space between the bulkheads with foam and reach the top of the adit.

Figure 13F:
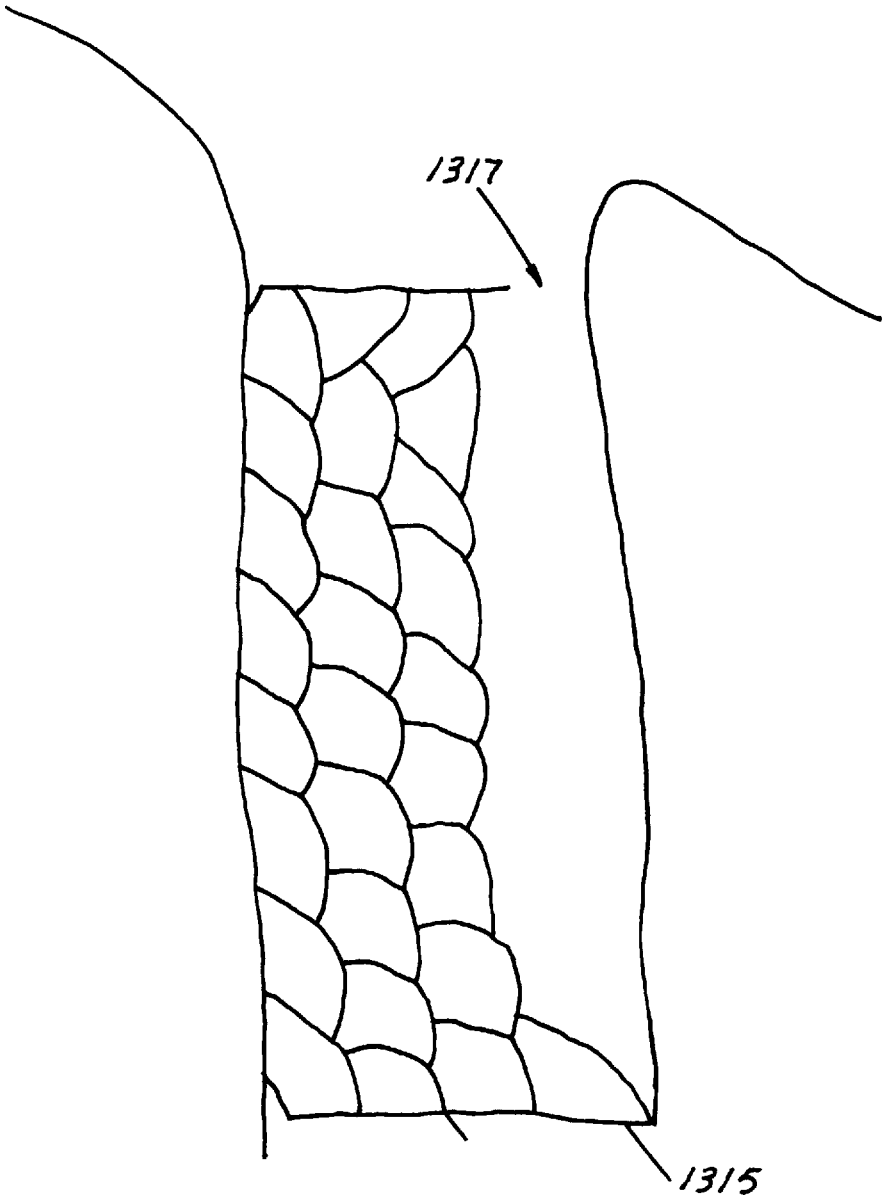
Figure 13G:
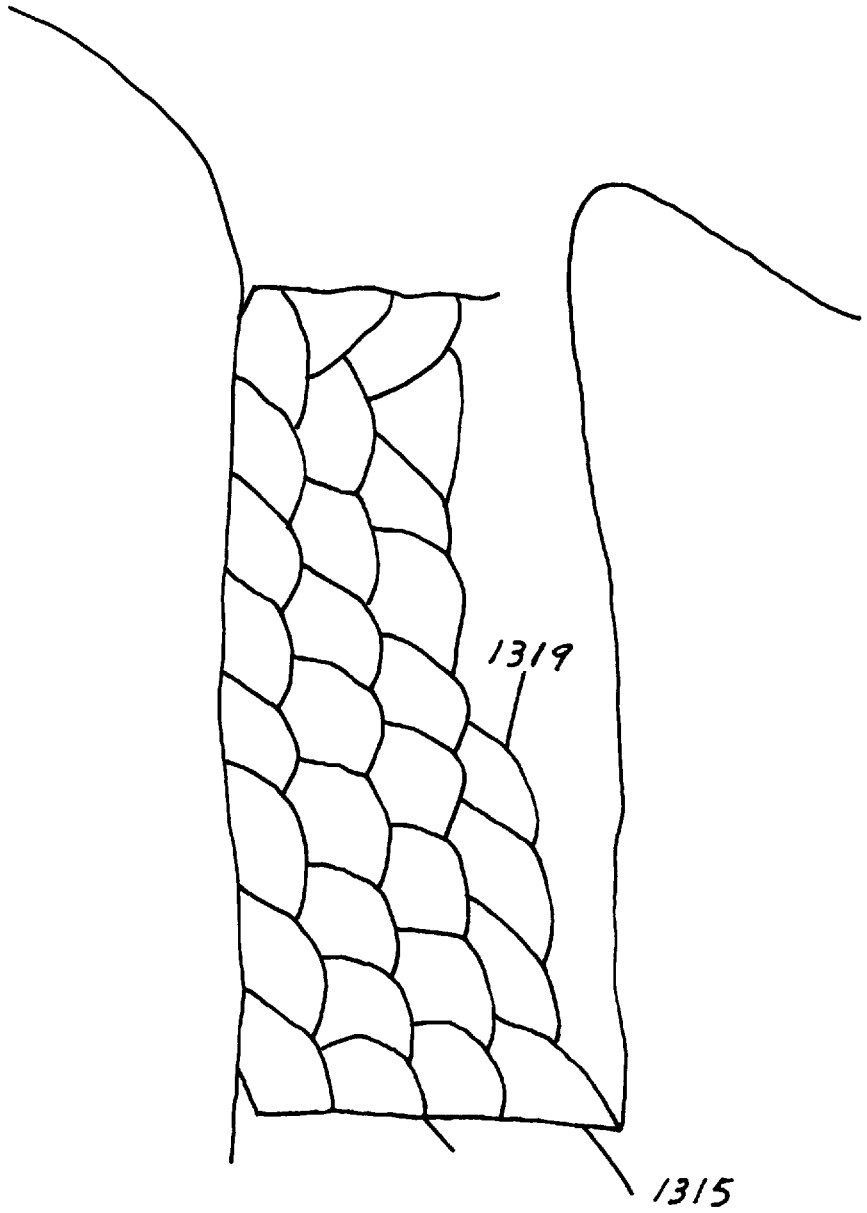
Figure 13H:
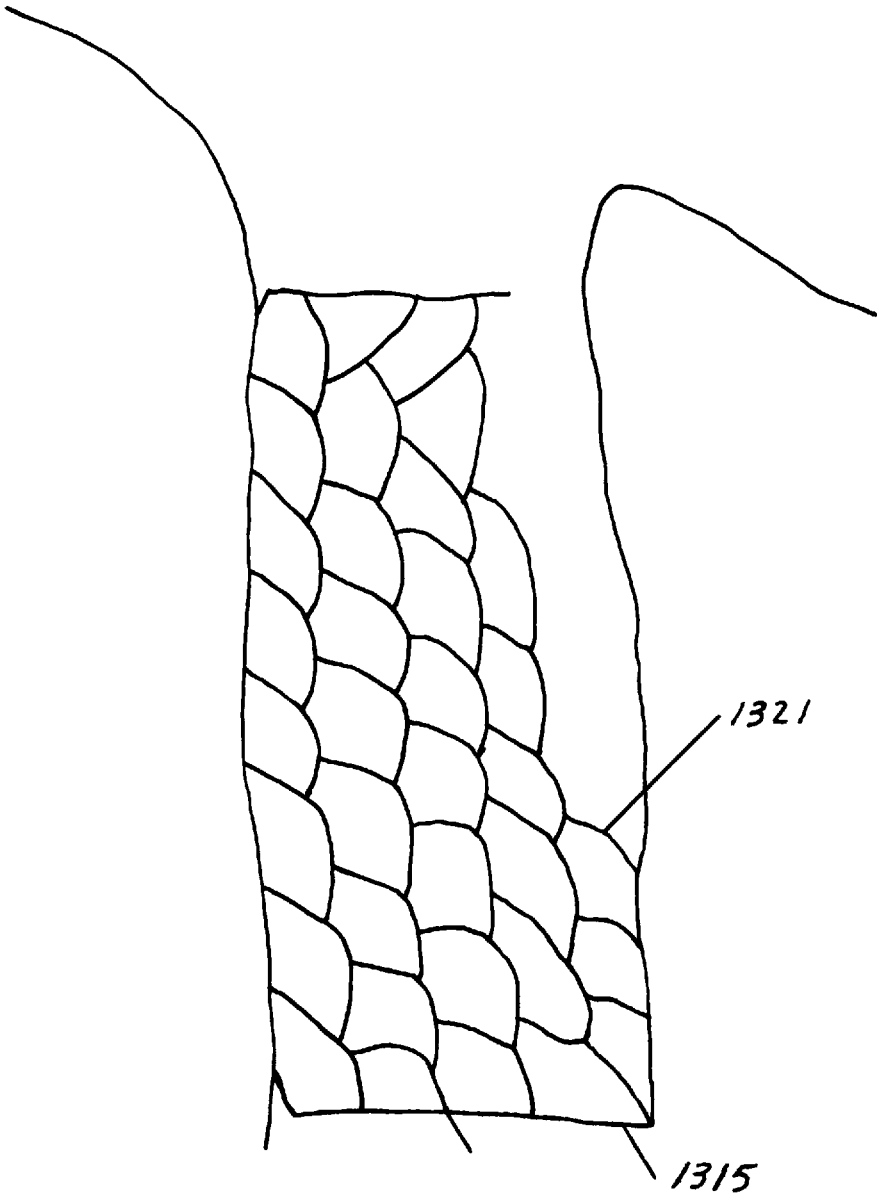
Figure 13I:
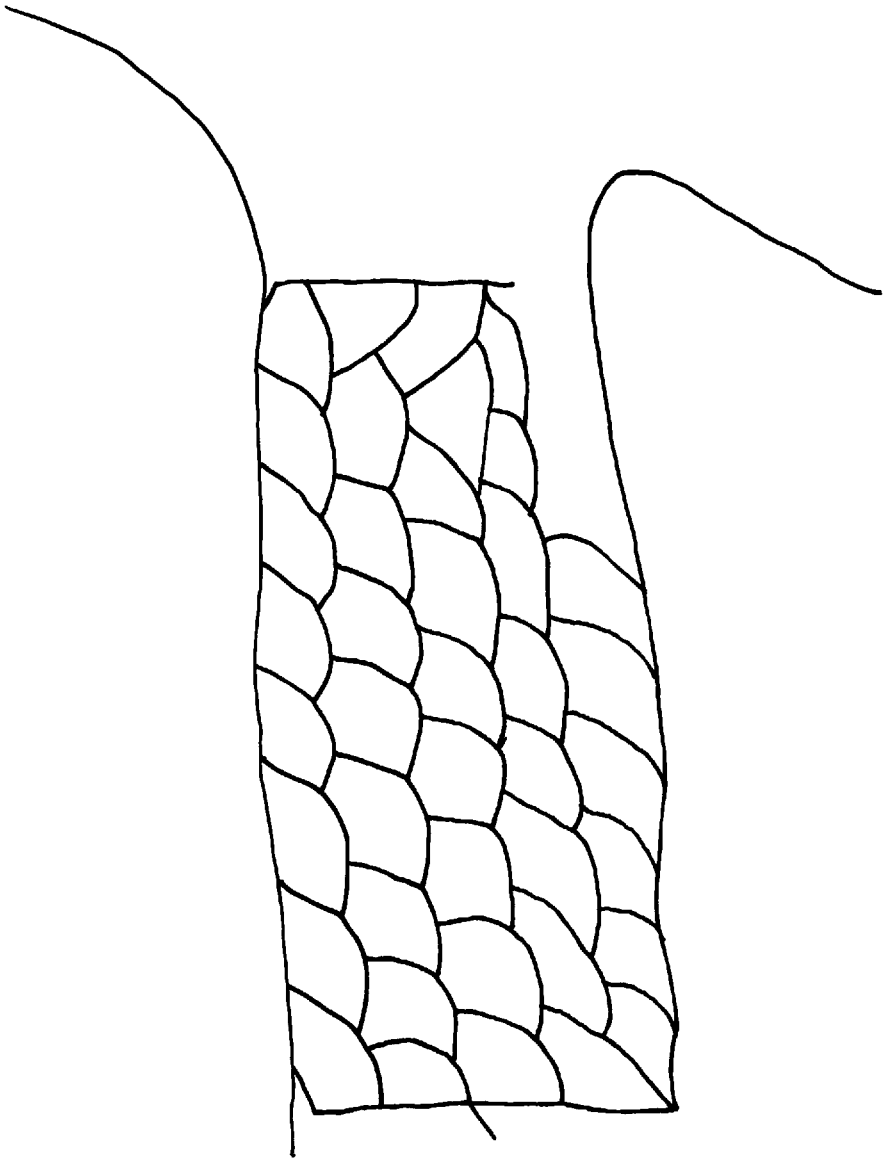
Figure 13J:
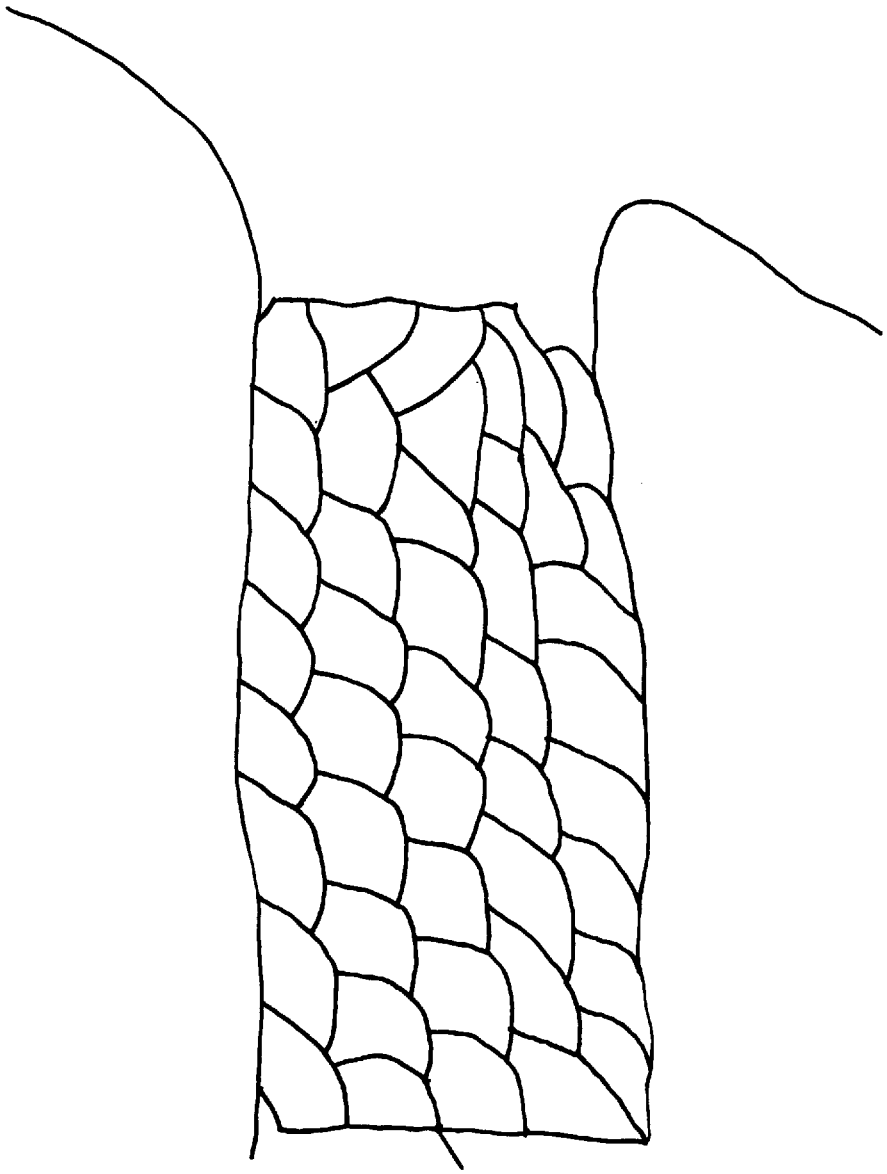
Figure 13K:
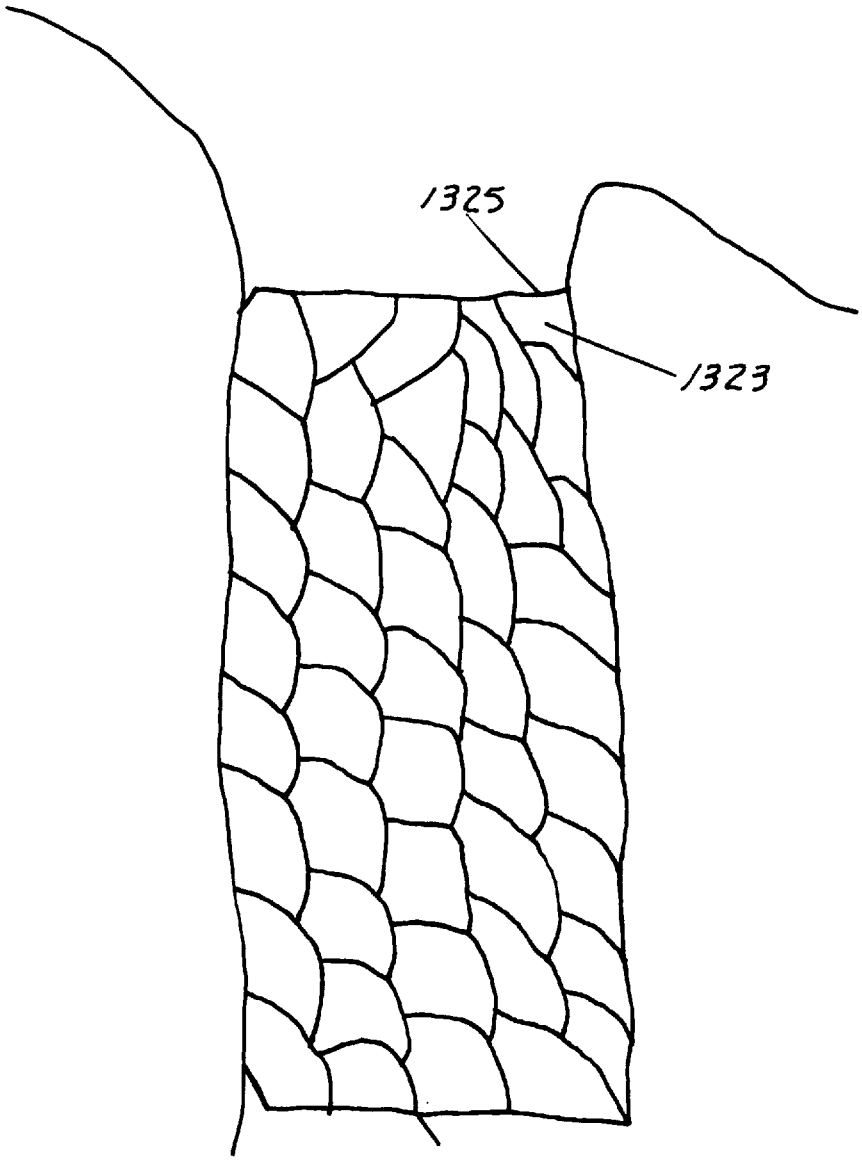

Upon reaching the top of the adit, only dam 1315 is placed across the back of the of the expansion foam plug in order to allow access from the front through opening 1317, as shown in FIG. 13*f*. Expansion foam 1319 is then filled in several feet from the back dam 1315, as shown in FIG. 13*g*. Next, expansion foam 1321 is filled to the top of the adit in front of the back dam 1315 as shown in FIG. 13*h*. Expansion foam is then applied from back to front as shown in FIGS. 13*i* and 13*j*. FIG. 13*k* shows the last expansion foam container 1323 being placed at the top of the adit. With this last container 1323, the cardboard dam 1325 is held in place by hand until the expansion foam hardens, thus completing the formation of the expansion foam plug.

To protect the front of the expansion foam plug from damage, it will be recognized that the front bulkhead may be constructed from many different materials, including tin, wood, mesh screening, or natural fill material such as native stone. Alternatively, a harder expansion foam, such as an 8 pounds pcf foam, may be placed in front of the front bulkhead to protect the previously constructed expansion foam plug, which typically is a softer foam such as 2 pounds pcf. The use of a hard expansion foam to protect the softer expansion foam plug is advantageous where natural fill or other materials are scarce.

The present invention is to be limited only in accordance with the scope of the appended claims, since others skilled in the art may devise other embodiments still within the limits of the claims.

What is claimed is:

1. A mine shaft closure apparatus comprising:

a platform having substantially the outline dimensions of a cross section of the mine shaft, the platform being positioned within the mine shaft at a predetermined location;

a plurality of expansion foam containers each having an inner pouch and an outer pouch formed from a liquid-impervious flexible film material, the inner pouch containing a first expansion foam component, the outer pouch containing the inner pouch and a second expansion foam component; and an expansion foam plug formed above the platform from the expansion foam containers by breaking the inner pouch of each expansion foam container and placing each expansion foam container on the platform;

wherein for each expansion foam container the first and second expansion foam components combine within the outer pouch to form an expansion foam slowly enough to provide sufficient time for the expansion foam container to be placed on the platform, the expansion foam bursting the outer pouch to form the expansion foam plug above the platform.

2. The mine shaft closure apparatus of claim 1 wherein for each expansion foam container the inner pouch is sealed in a fixed position within the outer pouch, sharing an edge forming a seam.

3. The mine shaft closure apparatus of claim 1 wherein for each expansion foam container the first expansion foam component substantially comprises an isocyanate compound and the second expansion foam component substantially comprises a polyol resin.

4. The mine shaft closure apparatus of claim 3 wherein for each expansion foam container the ratio of the first expansion foam component to the second expansion foam component is substantially 4 to 3.

5. The mine shaft closure apparatus of claim 3 wherein for each expansion foam container the second expansion foam component substantially comprises a polyol resin and freon mixture in combination.

6. The mine shaft closure apparatus of claim 5 wherein for each expansion foam container the ratio of polyol resin to freon mixture in the second expansion foam component is substantially 2 to 1.

7. The mine shaft closure apparatus of claim 1 wherein for each expansion foam container the thickness of the thin flexible film of the inner pouch is less than that of the thin flexible film of the outer pouch, such that when mechanical pressure is applied to the expansion foam container the inner pouch breaks before the outer pouch.

8. The mine shaft closure apparatus of claim 1 wherein for each expansion foam container the outer pouch is joined internally to the inner pouch along at least one edge.

9. The mine shaft closure apparatus of claim 1 wherein for each expansion foam container the inner pouch comprises a first volume substantially equal to the volume of the first expansion foam component, and wherein the outer pouch comprises a second volume substantially equal to the first volume plus the volume of the second expansion foam component.

10. The mine shaft closure apparatus of claim 1 wherein the platform further comprises attachment means located along the outer edge for facilitating the attachment of a tether.

11. The mine shaft closure apparatus of claim 1 wherein each expansion foam container further comprises attachment means joined externally to the outer pouch along at least one edge for facilitating the attachment of a tether.

12. The mine shaft closure apparatus of claim 1 wherein each expansion foam container further comprises a holding tab joined externally to the outer pouch along at least one edge to secure the expansion foam container to a rupture board.

13. A method of using a platform and a plurality of expansion foam containers to form a mine shaft closure, the expansion foam containers having an inner pouch containing a first expansion foam component and an outer pouch containing the inner pouch and a second expansion foam component, the method comprising the steps of:

a. positioning the platform within the mine shaft at a predetermined location;

b. for each expansion foam container (1) applying mechanical force to the expansion foam container to break the inner pouch, thereby combining the first and second expansion foam components within the inner pouch;

(2) mixing together the first and second expansion foam components within the outer pouch; and (3) placing the expansion foam container on the platform;

wherein for each expansion foam container the first and second expansion foam components combine within the outer pouch to form an expansion foam slowly enough to provide sufficient time for the expansion foam container to be placed on the platform, the expansion foam bursting the outer pouch to form an expansion foam plug above the platform.

14. The method of claim 13 further comprising the steps of:

(a) lowering the platform into the mine shaft to the predetermined position via an attached tether; and (b) maintaining the platform at the predetermined position until the expansion foam plug has formed above the platform.

15. The method of claim 13 further comprising the steps of:

(a) lowering each expansion foam container into the mine shaft to the predetermined position via an attached tether; and (b) maintaining each expansion foam container at the predetermined position until the expansion foam plug has formed above the platform.

16. An adit closure apparatus comprising:

first and second bulkheads having substantially the outline dimensions of a cross section of the adit, the first bulkhead being positioned within the mine shaft at a first predetermined location and the second bulkhead being positioned within the mine shaft at a second predetermined location;

a plurality of expansion foam containers each having an inner pouch and an outer pouch formed from a liquid-impervious flexible film material, the inner pouch containing a first expansion foam component, the outer pouch containing the inner pouch and a second expansion foam component; and an expansion foam plug formed between the first and second bulkheads from the expansion foam containers by breaking the inner pouch of each expansion foam container and placing each expansion foam container between the first and second bulkheads;

wherein for each expansion foam container the first and second expansion foam components combine within the outer pouch to form an expansion foam slowly enough to provide sufficient time for the expansion foam container to be placed between the first and second bulkheads, the expansion foam bursting the outer pouch to form the expansion foam plug between the first and second bulkheads.

17. The adit closure apparatus of claim 16 wherein for each expansion foam container the inner pouch is sealed in a fixed position within the outer pouch, sharing an edge forming a seam.

18. The adit closure apparatus of claim 16 wherein for each expansion foam container the first expansion foam component substantially comprises an isocyanate compound and the second expansion foam component substantially comprises a polyol resin.

19. The adit closure apparatus of claim 18 wherein for each expansion foam container the ratio of the first expansion foam component to the second expansion foam component is substantially 4 to 3.

20. The adit closure apparatus of claim 18 wherein for each expansion foam container the second expansion foam component substantially comprises a polyol resin and freon mixture in combination.

21. The adit closure apparatus of claim 20 wherein for each expansion foam container the ratio of polyol resin to freon mixture in the second expansion foam component is substantially 2 to 1.

22. The adit closure apparatus of claim 16 wherein for each expansion foam container the thickness of the thin flexible film of the inner pouch is less than that of the thin flexible film of the outer pouch, such that when mechanical pressure is applied to the expansion foam container the inner pouch breaks before the outer pouch.

23. The adit closure apparatus of claim 16 wherein for each expansion foam container the outer pouch is joined internally to the inner pouch along at least one edge.

24. The adit closure apparatus of claim 16 wherein for each expansion foam container the inner pouch comprises a first volume substantially equal to the volume of the first expansion foam component, and wherein the outer pouch comprises a second volume substantially equal to the first volume plus the volume of the second expansion foam component.

25. The adit closure apparatus of claim 16 wherein the first and second bulkheads are incrementally constructed during the formation of the expansion foam plug.

26. A method of using first and second bulkheads and a plurality of expansion foam containers to form an adit closure, the expansion foam containers having an inner pouch containing a first expansion foam component and an outer pouch containing the inner pouch and a second expansion foam component, the method comprising the steps of:

(a) positioning the first bulkhead within the adit at a first predetermined location and the second bulkhead within the adit at a second predetermined location;

(b) for each expansion foam container (1) applying mechanical force to the expansion foam container to break the inner pouch, thereby combining the first and second expansion foam components within the outer pouch;

(2) mixing together the first and second expansion foam components within the outer pouch; and (3) placing the expansion foam container between the first and second bulkheads;

wherein for each expansion foam container the first and second expansion foam components combine within the outer pouch to form an expansion foam slowly enough to provide sufficient time for the expansion foam container to be placed between the first and second bulkheads, the expansion foam bursting the outer pouch to form an expansion foam plug between the first and second bulkheads.

27. The method of claim 26 further comprising the step of incrementally constructing the first and second bulkheads during the formation of the expansion foam plug.

* * * * *